United States Patent [19]

Shea et al.

[11] Patent Number: 4,491,199

[45] Date of Patent: Jan. 1, 1985

[54] ELEVATOR SYSTEM

[75] Inventors: Henry J. Shea, Rockaway Township, Morris County; Elmer H. Sumka, Edison, both of N.J.

[73] Assignee: Westinghouse Electric Corp., Pittsburgh, Pa.

[21] Appl. No.: 509,120

[22] Filed: Jun. 29, 1983

[51] Int. Cl.[3] ..... B66B 13/02

[52] U.S. Cl. ..... 187/29 R; 340/19 A; 187/52 R

[58] Field of Search ..... 187/29, 51, 52, 56; 340/19 R, 19 A, 20

[56] References Cited

U.S. PATENT DOCUMENTS 3,513,945 5/1970 Hall et al. ..... 187/29

3,587,785 6/1971 Krauer et al. ..... 187/29

*Primary Examiner*—J. V. Truhe

*Assistant Examiner*—W. E. Duncanson, Jr.

*Attorney, Agent, or Firm*—D. R. Lackey

[57] ABSTRACT

An elevator system including at least one elevator car mounted in a building to serve the floors therein. The elevator car includes a door having one or more panels, and a door operator which selectively operates the door at the end of a run from the closed to a fully open position, or from the closed to a predetermined partially open position. Door control, in response to at least one predetermined parameter of the elevator system, controls the selection by the door operator. In a preferred embodiment, an audible message informs the passengers of the decision, at least when the doors will only be partially opened.

19 Claims, 9 Drawing Figures

148
READ PRP COUNT
150
PRP > K2
Y
N
152
PREPARE & OUTPUT MESSAGE #5
112
PREPARE & OUTPUT MESSAGE #1
116
COINCIDENT CALLS
Y
N
118
PREPARE & OUTPUT MESSAGE #2
114
RETURN
120
CAR CALL
N
Y
122
SET FLAG PO
124
PREPARE & OUTPUT MESSAGE #3
126
HALL CALL
Y
N
128
SET FLAG PO
130
PREPARE & OUTPUT MESSAGE #4

ELEVATOR SYSTEM

BACKGROUND OF THE INVENTION

1. Field of the Invention

The invention relates in general to elevator systems, and more specifically to elevator systems having door control which expedites elevator service to a building.

2. Description of the Prior Art

An elevator car stops at a target floor at the end of a run, and it opens its door and the hatch door for a predetermined period of time, referred to as the noninterference time. This time is selected to permit passenger entrance and egress. This noninterference time may be five seconds, for example. In order to improve elevator service, the noninterference time is shortened in certain instances, such as described in U.S. Pat. No. 3,580,360, which is assigned to the same assignee as the present application. A door which starts to close at the end of the noninterference time, may have the extent of reopening controlled in response to actuation of the door safety edge, such as disclosed in U.S. Pat. Nos. 2,740,496 and 2,847,089.

SUMMARY OF THE INVENTION

The present invention recognizes that elevator service may be significantly improved by controlling the extent of initial door opening, i.e., the width of the opening, at the end of a run in response to predetermined parameters of the elevator system which exist or occur up to the time deceleration of the car is initiated to stop the car at the target floor. These parameters are related to estimated or predicted passenger transfer at the target floor. For example, the detection of possible counter traffic flow at the target floor, such as when there are coincident car and hall calls, will allow the doors to open fully, as will the detection that the target floor is the main or lobby floor of the building. Other factors, such as the detection of passenger load, the number of registered car calls, the detection of traffic peaks, a stored history or record of passenger transfers per floor by time-of-day, and the like, are all used to predict when there will be one-way traffic flow of light intensity at a stop of the elevator car. The door, in such instances, is operated to a predetermined partially open position. The fact that one-third or more of all passenger stops involves the transfer of a single passenger illustrates that considerable time may be saved on each round trip of an elevator car by operating the doors to a less than a fully open position whenever practical. Time is saved on both opening and closing from the narrowed configuration.

To prevent passenger confusion in those instances when the car and hatch doors will not fully open, in a preferred embodiment of the invention an audible message is prepared and delivered prior to door opening. The message will explain that for the next stop, the doors will not open fully, and that a person intending to make a transfer should position one's self accordingly.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
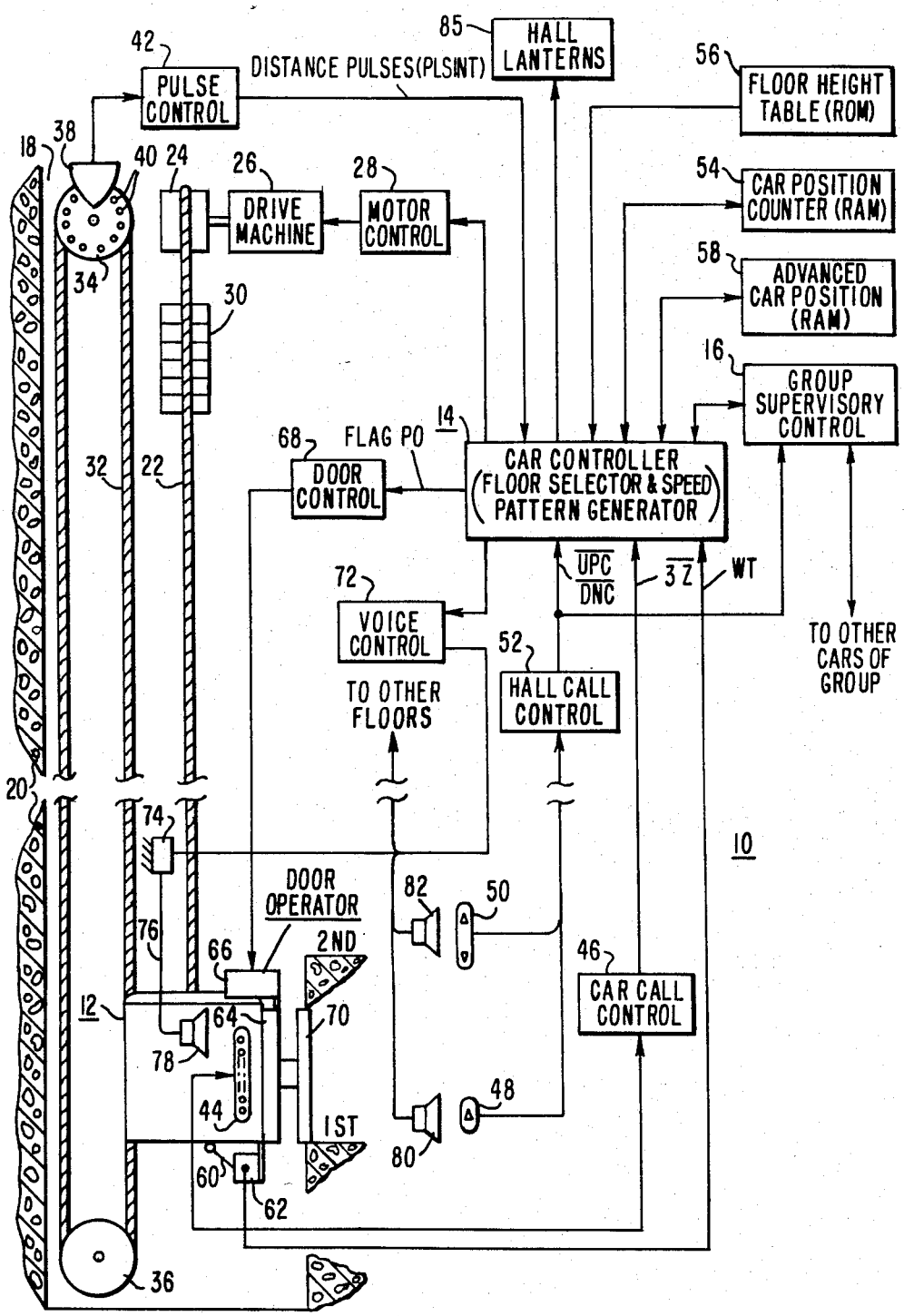
FIG. 1 is a partially schematic and partially block diagram of an elevator system constructed according to the teachings of the invention.

FIG. 1 is a partially schematic and partially block diagram of an elevator system 10 constructed according to the teachings of the invention. Elements of the elevator system 10 which are not pertinent to the understanding of the invention will not be described in detail. Reference will be made at the appropriate points of the description to U.S. patents, or copending patent applications, all assigned to the same assignee as the present application, for details of an operative elevator system. It is to be understood that each such patient and/or patent application is incorporated into the specification of the present application be reference.

More specifically, elevator system 10 includes an elevator car 12, the movement of which is controlled by a car controller 14. In turn, the car controller 14 may be under the control of a system processor 16, when the elevator system includes a plurality of elevator cars under group supervisory control. U.S. Pat. No. 3,750,850 sets forth a car controller, including a floor selector and speed pattern generator. U.S. Pat. No. 3,804,209 describes an interfacing arrangement for controlling and making assignments to a plurality of elevator cars under group supervisory control, which have car controllers similar to that shown in U.S. Pat. No. 3,750,850. U.S. Pat. No. 4,240,527 sets forth call answering strategy as well as computer control with a bidding arrangement for subprogram selection. Car 12 is mounted in a hatchway 18 for movement relative to a structure or building 20 having a plurality of floors or landings. Only the lower two floors are shown, in order to simplify the drawing. Car 12 is supported by a plurality of wire ropes 22 which are reeved over a traction sheave 24 mounted on a shaft of an elevator drive machine 26. The drive machine 26 may be an AC system having an AC drive motor, or a DC system having a DC drive motor, such as used in the Ward-Leonard drive system, or in a solid state drive system. Associated closed loop feedback control for the drive machine 26 is referred to generally as motor control 28. Motor control 28, which may be used, is shown in detail in U.S. Pat. No. 4,277,825.

A counterweight 30 is connected to the other ends of the ropes 22. A governor rope 32, which is connected to the car 12, is reeved over a governor sheave 34 located above the highest point of travel of the car in the hatchway 18, and under a pulley 36 located at the bottom of the hatchway, referred to as the pit. A pick-up 38 is disposed to detect movement of the elevator car 12 through the effect of circumferentially spaced openings 40 in the governor sheave 24, or in a separate pulse wheel which is rotated in response to movement of the elevator car 12. The openings 40 are spaced to provide a pulse or signal transition for each standard increment of travel of the elevator car 12, such as a pulse for each 0.25 inch of car travel. Pick-up 38 may be of any suitable type, such as optical or magnetic. Pick-up 38 is connected to pulse control 42 which provides distance pulses PLSINT for the car controller 14. Distance pulses may be developed in any other suitable manner, such as by a pick-up disposed on the elevator car 12 which cooperates with a coded tape disposed in the hatchway, or other regularly spaced indicia in the hatchway.

Car calls, as registered by pushbutton array 44 mounted in the car 12, are processed in car control 46, and the resulting information is directed to the car control 14. Car calls may also be registered by voice recognition circuits, if desired. Hall calls, as registered by pushbuttons mounted in the hallways, such as the up pushbutton 48 located at the lowest floor, and the up and down pushbuttons 50 located at the intermediate floors, are processed in hall call control 52. The resulting processed hall call information is directed to the car controller 14 and supervisory control 16. The hereinbefore-mentioned U.S. Pat. No. 3,750,850 sets forth suitable car call and hall control.

Figure 6:
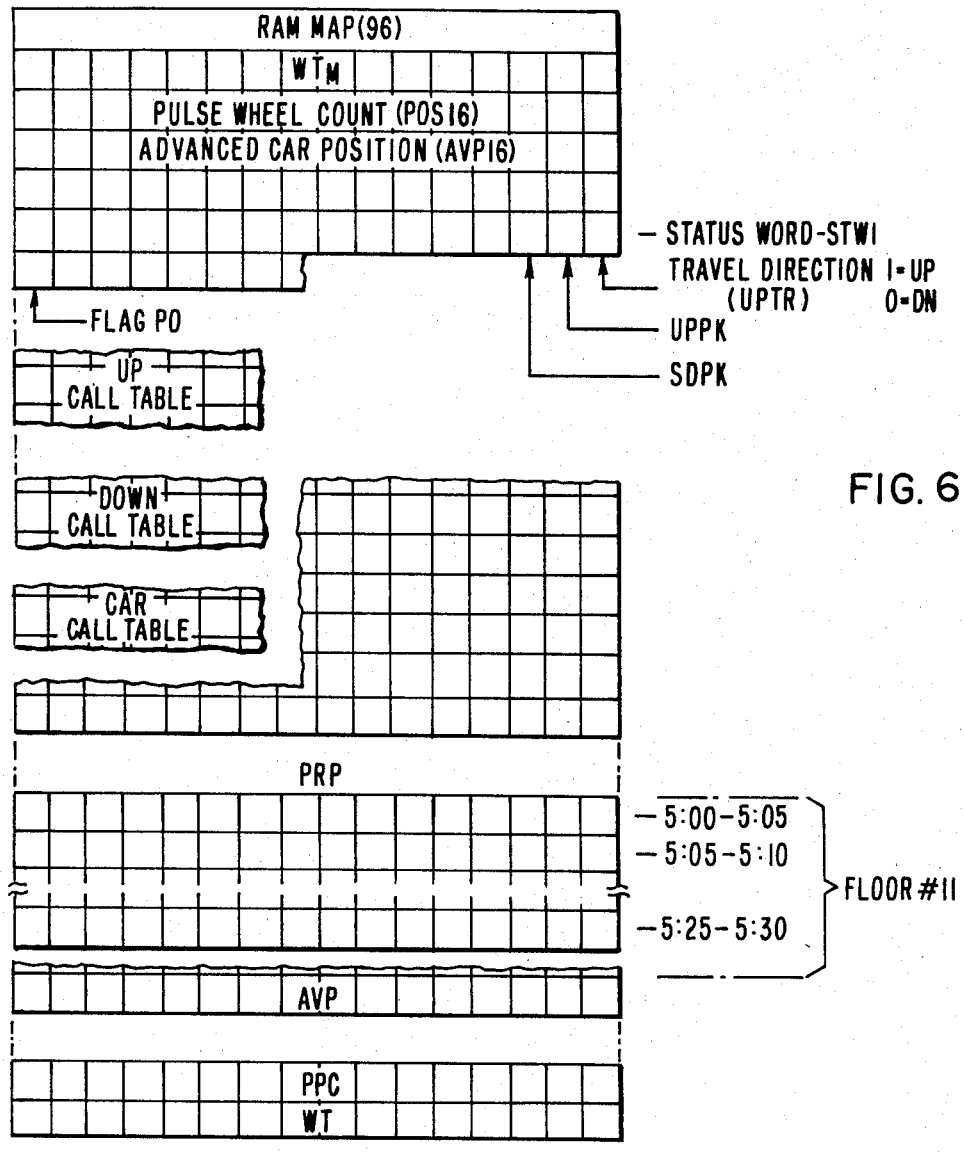
FIG. 6 is a RAM map which illustrates information developed during the operation of the elevator system and stored in one or more random access memories.
Figure 7:
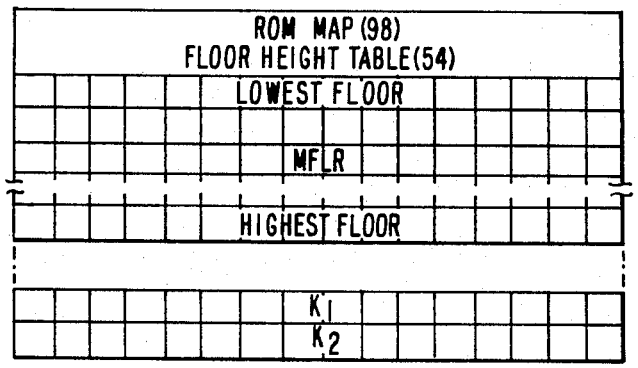
FIG. 7 is a ROM map which illustrates a floor height table and certain constants used by the program shown in FIG. 4.

The car controller 14 tabulates the distance pulses PLSINT from the pulse control 42 in an up/down counter 54 to develop information concerning the precise position of the car 12 in the hatchway 18, to the resolution of the standard increment. When the car 12 is at the lowest possible point of travel in the hatchway 18, the car position count, referred to as POS16, is zero. The POS16 count when the elevator car 12 is exactly level with each floor is used as the address for the associated floor. The address for each floor may be stored in a floor height table 56 which may be located in read-only memory (ROM) 98 illustrated in the ROM map of FIG. 7. The car controller 14 adds or subtracts the slowdown distance in terms of the standard count to POS16 to determine an advanced car position count 58, which may be stored in a random access memory (RAM) 96. A RAM map of RAM 96 is shown in FIG. 6. The advanced position count is referred to as AVP16. The advanced floor position AVP is the closest floor ahead of the elevator car 12 in its travel direction at which the car can stop according to a predetermined deceleration schedule. Thus, AVP16 is a binary number in terms of the standard count, and AVP is a binary number representing a floor number.

Car controller 14, in addition to keeping track of the position of the elevator car 12, also tabulates the calls for service for the elevator car, and it provides signals for starting the elevator car on a run to serve a call, or calls, for elevator service. The next floor in the travel direction of the elevator car at which the car should stop, to serve a car call, a hall call, or simply to park, is referred to as the target floor. When the AVP16 of the elevator car 12 reaches the address of the target floor, the car controller 14 provides a true signal DEC which initiates the slowdown phase of the run. Car controller 14 also controls the hall lanterns, shown generally at 85, and the resetting of the car calls and hall calls when they have been serviced.

A signal WT proportional to the weight of the passengers in the elevator car 12 may be developed by any suitable means. For example, the car floor may be resiliently mounted with passenger load being detected by an arm 60 which is actuated by the resiliently mounted floor. Control 62 may translate movement of the arm to an analog or digital signal WT. If generated in analog form, a suitable analog-to-digital converter may be used to store the signal WT in RAM 96.

Elevator car 12 includes a door 64 which is mechanically operated by a door operator 66. Door operator 66 is responsive to door control 68. When the elevator car 12 stops at a floor to load or unload passengers, the car door 64 unlocks and opens a hatch or hoistway door located at the floor, such as hatch door 70 shown at the lowest floor. Suitable door operators and control are shown in U.S. Pat. Nos. 2,740,496 and 4,004,655. As will be hereinafter explained, the extent of the door opening at the end of a run controlled as a function of predetermined elevator system parameters.

In a preferred embodiment of the invention, voice messages are prepared and reproduced in the elevator car 12, such as via voice control 72. If voice control 72 is located remotely from the elevator car 12, such as in the machine room, a junction box 74 and trail cable 76 may be used to connect voice control 72 with a speaker 78 located within the elevator car 12. Speakers may also be located at all of the floors, or at selected floors, such as speakers 80 and 82 at the first and second floors, respectively. Messages may be prepared and delivered via the floor mounted speakers to provide appropriate messages for prospective passengers from the voice control 72. Suitable voice control 72 which may be used is set forth in copending application Ser. No. 215,893 filed Dec. 12, 1980, entitled "Elevator System with Speech Synthesizer for Audible Information".

In accordance with the teachings of the invention, when the elevator car 12 prepares to stop at a target floor, a decision is made regarding the extent of initial door opening. This decision may be made by a door time saver program DTS shown in FIG. 4, which will be hereinafter described. Program DTS may be part of the car controller 14 and placed into bid when signal DEC goes true. Alternatively, program DTS may be part of the door control 68, as desired. For purposes of example, it will be assumed that program DTS is part of the car controller 14. For example, a program PGACC shown in copending application Ser. No. 446,149, filed Dec. 8, 1982, entitled "Speed Pattern Generator for an Elevator Car", may be used to place program DTM into bid when signal DEC goes true to initiate the slowdown phase of a run.

Figure 2:
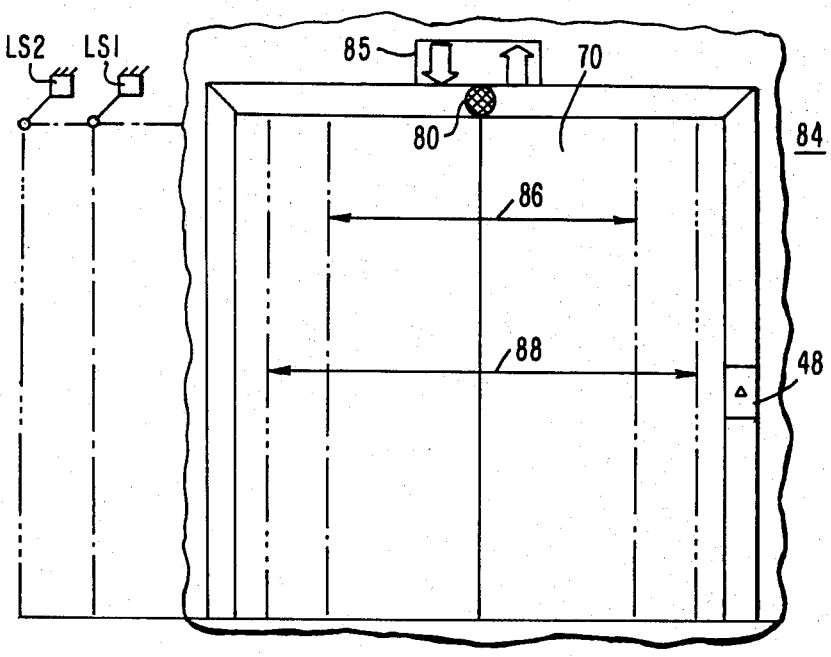
FIG. 2 is an enlarged front elevational view of a hall entranceway illustrating different door opening widths which may be utilized according to the teachings of the invention.

FIG. 2 is a front elevational view of the elevator entrance 84 at the first or lowest floor. The car and hatch doors may be single speed side opening (SSSO), single speed center opening (SSCO), two-speed side opening (2SSO), or two-speed center opening (2SCO), as desired. For purposes of example, they are illustrated as being SSCO.

Any number of different selectable partial door opening widths may be used, with one partially open position 86 being illustrated in FIG. 2, for purposes of example. The fully open position is illustrated at 88 in FIG. 2. Switches LS1 and LS2 may be used to provide signals when the opening doors reach the partially open position 86 and the fully open or limit position 88, respectively. For purposes of example, it will be assumed that position 86 is 75% as wide as position 88. The percentage of a partially open position depends to a large extent upon how wide the fully open position is. The wider the fully open position, the lower the percentage may be. For example, a partial opening which is only 50% of the full width opening may be used in certain instances.

Figure 3:
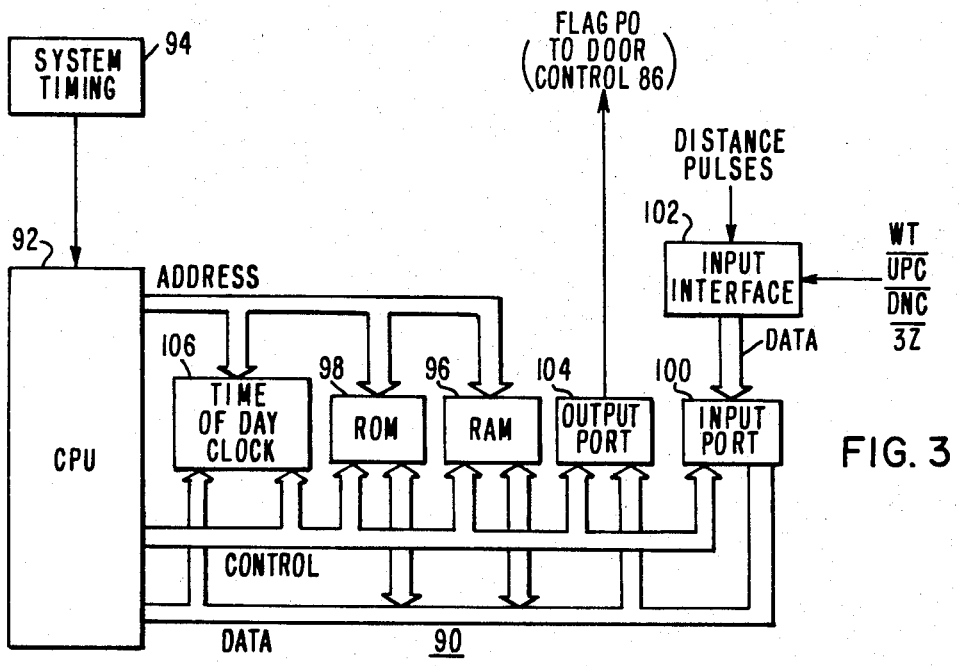
FIG. 3 is a block diagram of a microcomputer which may be used to implement a door control function according to the teachings of the invention.

FIG. 3 is a block diagram of a microcomputer 90 which may be included in the car controller 14 for processing the distance pulses PLSINT and calls for elevator service. A similar microcomputer may be used in door control 68 to run the door time saver program DTS shown in FIG. 4, if desired. As hereinbefore stated, it will be assumed that the door time saver program DTS will be run by a microcomputer included in the car controller 14.

More specifically, microcomputer 90 includes a central processing unit (CPU) 92, system timing 94, a random access memory (RAM) 96, a read-only memory (ROM) 98, an input port 100 for receiving signals from external functions via a suitable interface 102, ports for controlling the various functions shown in FIG. 1, such as an output port 104 for providing signals for door control 68, and a time-of-day clock 106. Microcomputer 90, for example, may be Intel's iSBC80/24 TM single board computer. With this computer, the CPU would be Intel's 8085A microprocessor, the timing function 84 would be Intel's clock 8224, and the input and output ports would be on-board ports.

Figure 4A:
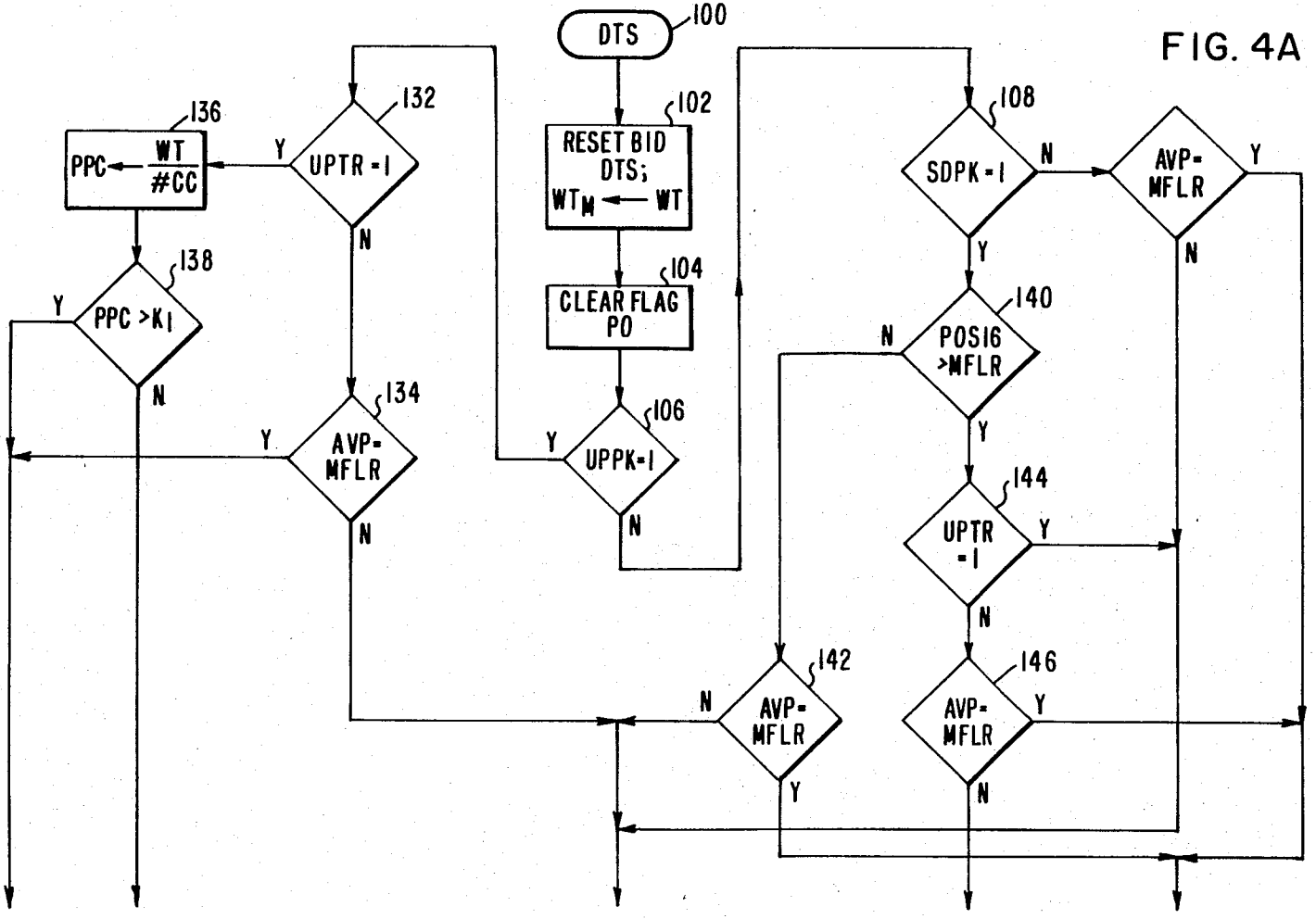
FIGS. 4A and 4B may be assembled to provide a flow chart of a door time saver program (DTS) which may be utilized by the microcomputer shown in FIG. 3 to predict estimated passenger transfer at each target floor and to provide a signal for a door operator which controls door opening width accordingly.
Figure 4B:
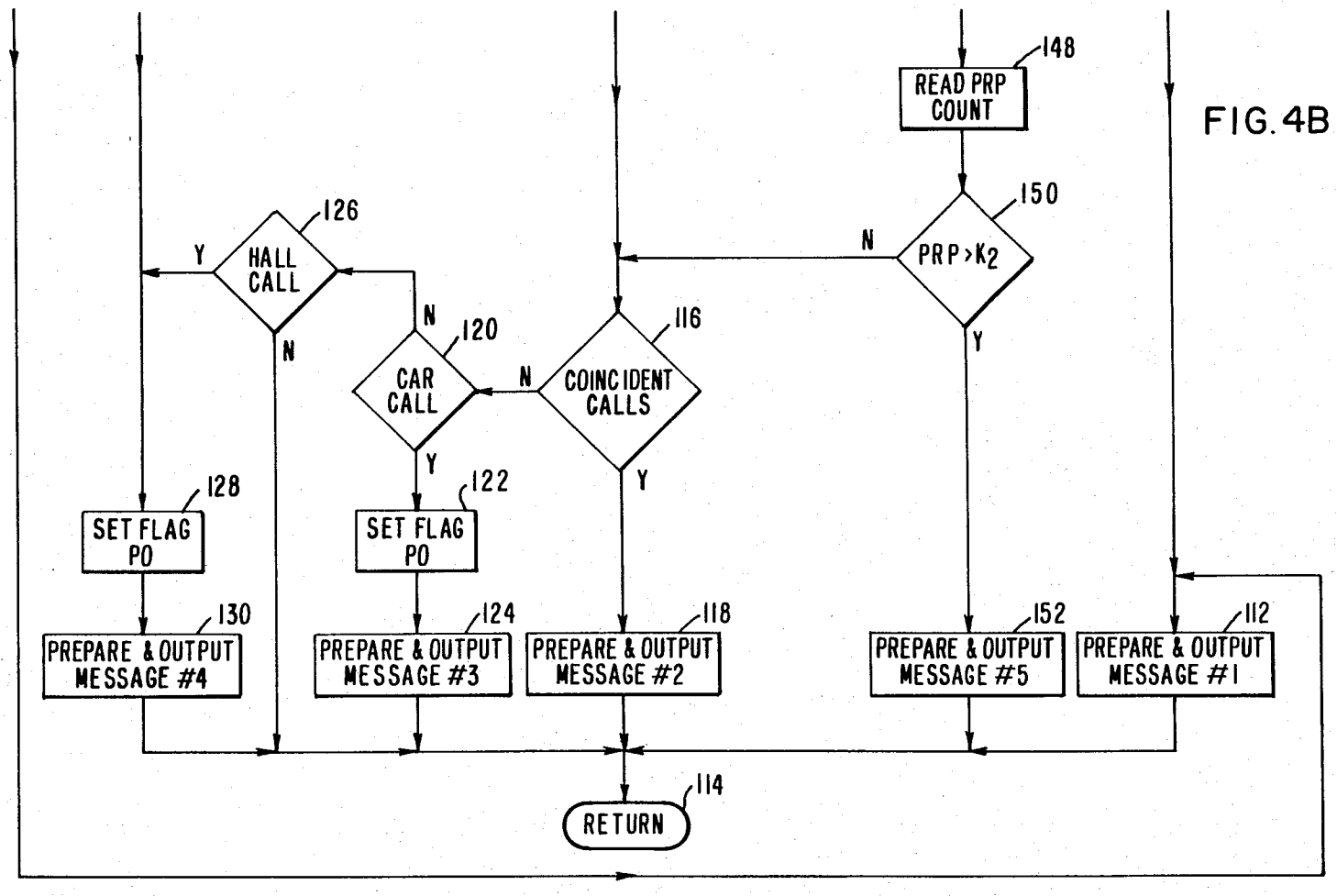

FIGS. 4A and 4B may be assembled to provide a detailed flow chart of the door time saver program DTS. The RAM and ROM maps of FIGS. 6 and 7 will be referred to when appropriate during the description of program DTS. As hereinbefore stated, program DTS may be placed into bid, or an appropriate flag set, once the target floor is positively identified and it is known that the next stop that the car will make will be at that floor.

Basically, the philosophy of program DTS is to open the car and hatch doors fully only when it is known or expected that: (a) there will be counterflow of traffic, i.e., both loading and unloading of passengers will occur at the target floor stop, (b) more than a predetermined number of passengers will depart the car at the target floor stop, or (c) more than a predetermined number of passengers will board the car at the target floor stop. At all other target floor stops, the doors will be controlled to only partially open.

Figure 8:
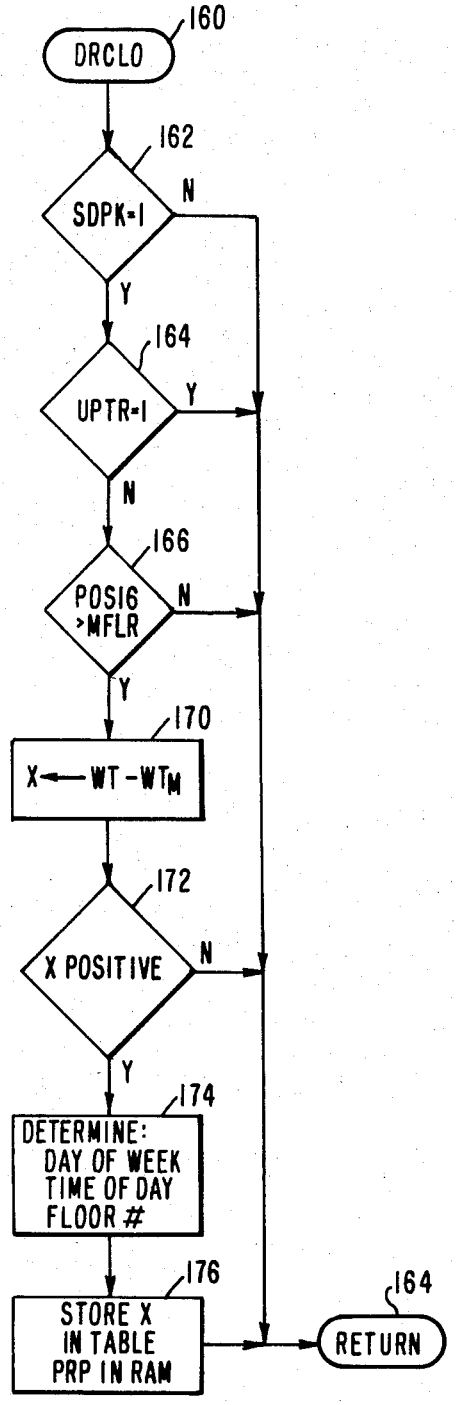
FIG. 8 is a flow chart of a program which may be used to develop a table of estimated passenger transfer, which program is stored in the RAM associated with the RAM map of FIG. 6.

More specifically, program DTS is entered at terminal 100 while the elevator car 12 is running and is preparing to stop at a target floor. If program DTS is being run as the result of being bid, it resets the bid in step 102. Step 102 also stores the passenger load WT found in the RAM map of FIG. 6 in a location referred to as $WT_M$. The purpose of this will be apparent when the program of FIG. 8 is described. Step 104 then clears a door partial-open flag PO in RAM 96, which program DTS will subsequently set if it determines that the car and hatch doors should only partially open at the target floor. If program DTS does not set the door partial-open flag PO during the running of the program, the doors will automatically fully open. Step 106 checks the bit UPPK in RAM 96. Bit UPPK is set when the elevator system 10 is in an up-peak traffic mode. For example, bit UPPK may be set in response to an elevator car leaving the main or lobby floor in the up travel direction with a passenger load which exceeds a predetermined percentage of weight capacity, such as 50%. For example, FIG. 20C of U.S. Pat. No. 3,851,734 activates a timer UPTIM when an elevator car leaves the main floor with a load exceeding 50% of rated capacity, and FIG. 18 of this same patent sets the system up peak bit UPPK when the timer UPTIM is found to be active.

If the elevator system is not in an up-peak traffic condition, step 106 proceeds to step 108 which checks to see if the system is in a down-peak traffic condition. This may be done by checking the bit SDPK in the RAM 96. When a down-traveling elevator car bypasses down hall calls due to passenger load exceeding a predetermined percentage of rated capacity, a bit BYPS is set, as explained in U.S. Pat. No. 3,750,850. When this occurs, a system down-peak timer DPK is activated, and FIG. 18 of the '734 patent mentioned above sets the system down-peak bit SDPK when it finds the timer DPK active.

If the elevator system is not in a down-peak traffic condition, step 110 checks to see if the target floor is the main or lobby floor of the building. Once slowdown has been initiated, the target floor is the same as the advance floor position AVP. Thus, step 110 compares the AVP of the elevator car with the binary address MFLR of the main floor. If the two addresses are equal, the car is in the process of stopping at the main floor. If the car is arriving at the main floor, the doors will be allowed to fully open. Thus, since the doors will open fully unless flag PO is set, there is nothing further that program DTS has to do. In a preferred embodiment of the invention, voice synthesis, or any other suitable type of message apparatus, is utilized to formulate and deliver a verbal message each time the decision is made to open the doors to a partially open condition. The voice capability may be utilized to formulate verbal messages each time the car prepares to stop, regardless of the door opening width selected. Thus, step 110 may proceed to a step 112 which prepares an appropriate message for the passengers in the elevator car. For example, such a message may be "the doors will open fully, please exit side-by-side". This message would be delivered via speaker 78 located in the elevator car 12. Step 112 may also formulate a message for any prospective passengers at the target floor, such as "Car No. 1 is arriving. Please allow passengers room to depart". These two messages are referred to generally as message No. 1. Step 112 exits the program DTS at exit point 114, and control is returned to a priority executive program which selects the next program having a need to run.

Should step 110 find that the elevator car 12 is not stepping at the main or lobby floor, step 110 proceeds to step 116 which checks to see if there are coincident car and hall calls at the target floor. In other words, step 116 checks the car and hall call table shown in the RAM map of FIG. 6. If the car is traveling downwardly and has a registered car call for the target floor, and its service direction after the stop is down, step 116 would check the down hall call table to see if there is a registered down hall call at the target floor. If so, the doors of the car and hatch will be allowed to fully open, as it is now known that there will be counterflow of passenger traffic at this floor. Step 116 may proceed to step 118 for the preparation of appropriate messages, referred to as message No. 2. For example, the message may state "Floor No. 5. The doors will open fully. Please exit single file to your right". This message would be prepared for and delivered by the in-car speaker 78. The message "Car No. 1 is arriving and doors will fully open, please enter single file to your right", may be prepared for and delivered by the speaker in the hallway of the target floor. The program would then exit at terminal 114. If step 116 does not find coincident calls, step 116 proceeds to step 120 which checks to see if the elevator car is stopping because of a car call. Since there is no traffic peak, the car is not stopping at the main floor, and there is no hall call registered for the service direction of the car, a stop for a car call under these circumstances would indicate the departure of only one or two passengers. Thus, time may be saved by opening the door to a predetermined semi-open position, such as one-half or three-fourths of the normal full-opened width. Step 122 sets flag PO. If flag PO will be set in a memory which is accessed by the door control 68, this is all that needs to be done. Otherwise, step 122 would also include the step of outputting a true signal PO to the door control 68.

Step 122 advances to step 124 which prepares and outputs message No. 3. Message No. 3 for car speaker 27 may state "Floor No. 5. The doors will partially open. Please exit single file". Since there should be no prospective passengers at the target floor, no message needs to be prepared for the associated floor speaker. However, one may be prepared and delivered, if desired, which would take care of a prospective passenger who has failed to register an appropriate hall call. For example, the message for the floor speaker may state "Car No. 1 is arriving for down service. The doors will only partially open. Please allow passengers to depart before attempting to enter".

If step 120 does not find a car call, step 120 proceeds to step 126 to see if it is a hall call stop, i.e., step 126 checks the RAM map shown in FIG. 6 for a hall call in the service direction of the elevator car. If step 126 finds it is a hall call stop, it proceeds to step 128 which sets the door partial-open flag PO, and to step 130 which prepares appropriate messages, referred to as message No. 4. A message for the car speaker might state "Floor No. 6. The doors will partially open. Please step to the rear of the car to make room for entering passengers". The message for the associated hallway speaker might state "Car No. 1 is arriving for down service. The doors will partially open. Please position yourself accordingly".

If step 126 does not find an appropriate hall call, the step 126 simply proceeds to the exit terminal 114, as the stop may be to simply park the car at a predetermined floor.

If step 106 finds that the elevator system is in an up-peak condition, step 106 will proceed to step 132 which checks bit UPTR in RAM 96, as set forth in FIG. 6, to determine the car travel direction. If the car travel direction is up, bit UPTR will be a logic one, and if the travel direction is down, it will be a logic zero. If step 132 finds the car to be traveling downwardly, step 134 checks to see if the car is in the process of stopping at the main floor. This step is similar to step 110, hereinbefore described. If the car is stopping at the main floor, the doors will be allowed to fully open. It is not likely that there will be any passengers in the car, as most cars will be expressed to the main floor after serving up calls during an up-traffic peak, in order to satisfy a main floor quota. However, since down calls have to be serviced, even during an up peak, certain of the cars will stop for down calls. Thus, since there may be passengers, step 134 may proceed to step 112 to prepare and deliver message No. 1.

If step 134 finds the down-traveling car is not in the process of stopping at the main floor, step 134 proceeds to step 116 and the options and steps thereafter, which have been hereinbefore described.

If step 132 finds the elevator car to be traveling upwardly during an up-traffic peak, the doors may simply be allowed to open fully at each stop. However, in a preferred embodiment of the invention, round trip time for the elevator car is reduced by determining how many passengers are likely to depart at any given stop. If the car calls are registered via voice recognition circuits instead of via car call buttons, the number of verbally entered calls for each floor may be counted to help provide this information. This information may also be determined, when car call pushbuttons are used, for example, by step 136 which divides the weight WT of the passengers by the number of registered car calls (#cc). The passenger weight is provided by the signal WT, and the number of car calls may be obtained from the RAM map of FIG. 6. The result of this calculation is stored at a location referred to as PPC in RAM 96. Signal PPC is the passenger-per-call estimate. Step 136 then proceeds to step 138 where PPC is compared with a predetermined constant $K_1$ stored in ROM 98, as shown in the ROM map of FIG. 7. If it is estimated that on the average a passenger weighs 150 pounds, and that it is desired to open the doors fully if three or more passengers are likely to depart at the target floor, constant $K_1$ may be the digital equivalent of 300 pounds. In other words, if the passenger-per-call estimate PPC exceeds a $K_1$ of 300, the doors will be allowed to fully open, and step 138 may proceed to step 112 to prepare and deliver message No. 1.

If step 138 estimates only one or two people will probably depart at the target floor, it proceeds to step 128 to set flag PO, and step 130 prepares an outputs message No. 4.

If step 108 finds a system down-traffic peak condition exists, step 108 proceeds to step 140 which checks to see if the car is physically located above the main floor. This is done by comparing the car position count POS16 found in the RAM map of FIG. 6 with the digital address MFLR of the main floor. If POS 16 does not exceed MFLR, it has to be less than MFLR. It cannot equal MFLR, as the elevator car is moving and has just initiated the slowdown phase of the run. If POS 16 is less than the MFLR count, the car is located in a basement zone, and step 140 proceeds to step 142 which checks to see if the car is in the process of landing at the main floor. This step is similar to step 110. If not, the car is making a basement floor stop, and the program proceeds to step 116 and the options and steps related thereto, which have been hereinbefore described. If step 142 finds the elevator car to be in the process of stopping at the main floor, it proceeds to step 112 to prepare and deliver message No. 1.

If step 140 finds the elevator car to be located above the main floor, step 144 checks the car's travel direction, which step is similar to step 132. If the elevator car is an up-traveling car, it is stopping for a car call or a hall call during a down-traffic peak, and it is not likely there will be many passengers transferring at this stop. The strategy starting at step 116 will be adequate to handle this situation, and step 144 proceeds to step 116 when it finds bit UPTR true.

If step 144 finds the elevator car, which is above the main floor, is traveling downward, it proceeds to step 146 to determine if the car is in the process of stopping at the main floor. This step is similar to step 110. If so, step 146 proceeds to step 112 to prepare an output message No. 1.

If step 146 finds the elevator car is not stopping at the main floor, the strategy may be to allow a car above the main floor traveling downwardly to open its doors fully at all stops during the down-peak traffic condition. In a preferred embodiment of the invention, however, the strategy is to predict how many passengers will enter the car from the specific floor at which the car is stopping, at the present time of day. This may be determined by experience over a predetermined period of time and this experience may be in the form of a fixed table stored in ROM 98. However, in a preferred embodiment of the invention, a dynamic table is prepared and stored in RAM 96, using such information as the signal SDPK, the signal WT, the floor number, and the time of day as determined from the time-of-day clock 106. A program for preparing a suitable table is set forth in FIG. 8, which will be hereinafter described. If the depopulation pattern is the same every day, a single table will suffice. Otherwise, a different table may be prepared for each working day. The entries are stored in the prospective passenger table PRP in RAM 96, as shown in the RAM map of FIG. 6. The entries are in the terms of the weight as the passengers likely to board at the target floor at the specific time of day of the stop. The time may be in five-minute intervals, for example, during the existence of a system down-peak condition, as indicated for floor No. 11 in FIG. 6.

Thus, in a preferred embodiment of the invention, step 146 advances to step 148 which reads the PRP entry for the target floor at the present time of day, and step 150 compares PRP with a predetermined constant $K_2$ stored in ROM 98. For purposes of example, it will be assumed that $K_2$ is 450. Thus, if step 155 finds PRP exceeds $K_2$, the number of passengers likely to enter at the target floor exceeds three, for example, the doors will be allowed to open fully. Step 150 may proceed to step 152 to prepare appropriate messages, referred to generally as message No. 5. For example, the message prepared for delivery in the elevator car may state "Floor No. 5, the doors will open fully. Please step to the rear to allow room for entering passengers". The message prepared for and delivered for prospective passengers located in the hallway may state "Car No. 1 is stopping and the doors will fully open. Please enter side-by-side". If PRP does not exceed $K_2$, the number of passengers expected to enter is three, or less, for example, and if there will be no counter traffic flow, the doors may be allowed to only partially open. Thus, step 150 may proceed to step 116 and the options and steps hereinbefore described relative thereto.

Figure 5:
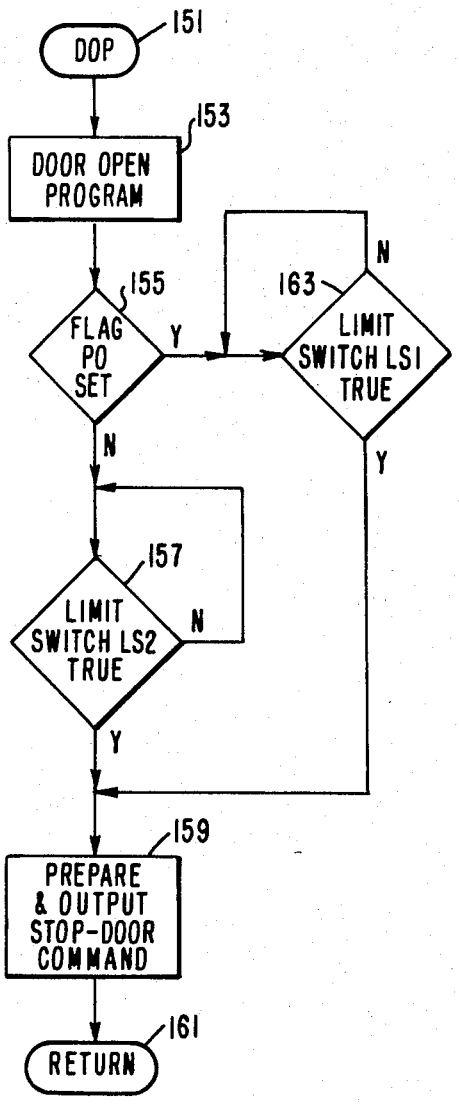
FIG. 5 is a flow chart of a program which may be used by the door operator to respond to the door width decision of the door time saver program DTS.

If door control 68 is hard wired, signal PO, when true, may simply operate a relay having a contact which renders switch SW1 effective. If door control 68 includes a microcomputer, a door open program may include steps such as those shown in the flowchart of FIG. 5.

Specifically, the door open program DOP is entered at terminal 151 and the program steps which initiate door movement are followed, which steps are shown generally at 153. Step 155 checks flag PO. If flag PO is not set, the doors will be allowed to open fully and step 157 checks a signal responsive to the limit switch LS2 shown in FIG. 2. When LS2 is actuated by the door, step 159 stops the doors and program DOP exits at 161. If step 155 finds flag PO set, the doors will be allowed to partially open, and step 163 monitors limit switch LS1. When switch LS1 is actuated by a door, step 159 stops the doors and the program exits at 161.

FIG. 8 is a flow chart of a program DRCLO which may be placed in bid when the doors are closed at the start of a run. Program DRCLO may be used to prepare and update table PRP shown in the RAM map of FIG. 6.

More specifically, program DRCLO is entered at 160 and step 162 checks bit SDPK in RAM 96 to see if the elevator system is in a down-peak traffic condition. If it is not, the program simply returns to the priority executive at 164. If step 162 finds the elevator system is in a down-traffic peak, step 164 checks bit UPTR in RAM 96 for the car's travel direction. If the car's travel direction is up, the program returns to the priority executive at 164. If the travel direction is down, step 164 proceeds to step 166 to check to see if the car is located above the main floor. If it is not, the program returns to the priority executive of 164. If the elevator car is located above the main floor, step 166 proceeds to step 170 which determines the weight of the passengers which entered the car at this floor. This may be accomplished by subtracting the memorized weight $WT_M$, which represents the passenger load prior to the present stop, from the present weight WT of the passenger load. The difference is stored in a variable location of RAM referred to generally as X. Step 172 then checks to see if X is positive. If it is not, the program returns to the priority executive at 164. If step 172 finds that X is positive, step 174 determines the day of the week, the time of the day and the floor number. If a table is not prepared for each day of the week, step 174 would not have to determine the day of the week. Step 176 then stores the contents of location X in the appropriate position in table PRP in RAM 96. Step 176 then returns to the priority executive at 164.

The following example, taken from standard traffic data, illustrates the potential time savings by utilizing the teachings of the invention. For a car having a 3500 pound passenger capacity rated at 500 FPM contract speed, the number of passengers per trip for a building having ten floors could be 19. The probable number of stops would be 8.2. With the center opening doors having an open width of 4', the door time for full opening is 4.8 seconds. For a 3' wide opening the time would be 3.6 seconds. Conservatively, one-third of the stops would involve only one passenger. Thus, assuming that the doors are opened to 3' on three of the stops, the 3.6 seconds saved per car per trip would save 21.6 seconds for a six-car bank. This is the equivalent of adding two-thirds of an additional elevator car to the bank, and the time savings in this example does not count the savings in closing time for the narrower width, or the savings involved when the program DTS would command partial door opening for passenger transfers which would involve only two or three passengers.

We claim as our invention:

1. An elevator system in a building having a plurality of floors, comprising:

an elevator car having door means, said elevator car being mounted for guided movement in the building to serve the floors, means for entering calls for elevator service, means for causing said elevator car to make a run to a predetermined target floor to serve a call for elevator service, and door operator means for selectively operating said door means at the end of a run to permit entrance to and egress from said elevator car, with said selection including:

operating said door means from a closed position to a fully open position (A), and operating said door means from a closed position to a predetermined partially open position (B), said door operator means including door control means responsive to at least one parameter of the elevator system for controlling said selection.

2. The elevator system of claim 1 including means for providing a signal responsive to passenger load in the elevator car, with the at least one parameter being said passenger load signal.

3. The elevator system of claim 1 wherein the means for entering calls for elevator service includes means for entering both hall and car calls, and the door control means includes means for detecting the existence of a car call for the target floor associated with a hall call at the floor which has the same service direction as the elevator car, with the at least one parameter being the detection of such coincident calls.

4. The elevator system of claim 1 including traffic peak means for identifying at least one type of traffic peak being experienced by the elevator system, with the at least one parameter being the detection of said at least one type of traffic peak.

5. The elevator system of claim 1 including message means for providing audible messages in the elevator car, with said message means being responsive to the selection of (B) by the door control means to provide a message informing the passengers that the door means will not open fully at the next stop.

6. The elevator system of claim 3 including message means for providing audible messages in the elevator car and at least certain of the target floors, with said message means providing a message within the car and also at the target floor associated with coincident calls and with the door control means selecting (A) for a target floor having coincident calls.

7. The elevator system of claim 1 including traffic peak means for detecting the existence of an up-traffic peak, means for detecting the passenger load in the elevator car, means for providing a signal responsive to the travel direction of the elevator car, with the door control means including means responsive to passenger load for predicting the number of passengers who will exit the elevator car at a target floor during up travel of the car during an up-traffic peak condition, with the door control means selecting (B) when the predicted number is less than a predetermined value, and otherwise selecting (A).

8. The elevator system of claim 1 wherein the door control means includes means for detecting when the target floor is the main floor, selecting (A) in response to such a detection.

9. The elevator system of claim 3 including traffic peak means for detecting the existence of an up-traffic peak, means for providing a signal responsive to the travel direction of the elevator car, and wherein the door control means includes means for detecting when the target floor is the main floor, and means for detecting the existence of coincident car and hall calls at the target floor, selecting (B) in the absence of coincident calls at the target floor during down travel of the elevator car during an up-traffic peak for a non-main-floor stop.

10. The elevator system of claim 9 including means for providing audible messages in the elevator car, with the message content being responsive to whether the stop is a car call stop, or a hall call stop.

11. The elevator system of claim 3 wherein the door control means includes means for detecting when the elevator car is located below a predetermined main floor, and means for detecting when the target floor is the predetermined main floor, selecting (B) in the absence of coincident calls at the target floor when the elevator car is below the main floor, stopping at a floor other than the main floor.

12. The elevator system of claim 3 including means providing a signal responsive to car travel direction, traffic peak means for detecting the existence of a down-traffic peak, and wherein the door control means includes means for detecting when the elevator car is located above the main floor, selecting (A) in the absence of coincident calls at the target floor during up travel above the main floor during a down-traffic peak.

13. The elevator system of claim 3 including traffic peak means for detecting the existence of a down-traffic peak, means for providing a signal responsive to travel direction of the elevator car, and wherein the door control means includes means for detecting when the elevator car is above the main floor, selecting (A) when the elevator car is above the main floor traveling downwardly during a down traffic peak.

14. The elevator system of claim 13 wherein the door control means includes means for detecting when the target floor is the main floor, and including means providing an audible message in the elevator car, with the message content being responsive to whether or not the target floor is the main floor.

15. The elevator system of claim 3 including means for detecting the existence of predetermined traffic peaks, and wherein the door control means includes means for detecting when the target floor is the main floor, selecting (B) for a non-main floor target floor stop in the absence of a traffic peak, and in the absence of coincident calls at the target floor.

16. The elevator system of claim 1 wherein the means for entering calls for elevator service includes means for registering car calls in the elevator car, and door control means includes means for estimating the number of passengers in the elevator car, means for dividing the estimated passenger count by the number of registered car calls to obtain a passenger per call (PPC) estimate, with the door control means being responsive to the PPC.

17. The elevator system of claim 16 wherein the door control means includes means for comparing the PPC with a predetermined constant $K_1$, selecting (A) when the PPC exceeds $K_1$ and otherwise selecting (B).

18. The elevator system of claim 1 including means for detecting a down-traffic peak, and wherein the door control means includes means for estimating the number of prospective passengers (PRP) at each floor by time-of-day during such a down-traffic peak detection, with the door control means being responsive to the PRP for the target floor.

19. The elevator system of claim 18 wherein the door control means includes means for comparing the PRP with a predetermined constant $K_1$, selecting (A) when the PRC exceeds $K_2$ and otherwise selecting (B).

* * * * *